US005160478A

United States Patent [19]

Rothfuss et al.

[11] Patent Number: 5,160,478

[45] Date of Patent: Nov. 3, 1992

[54] GAS FLUSHING APPARATUS FOR METALLURGICAL VESSEL

[75] Inventors: Hans Rothfuss, Taunusstein; Herbert Metzger, Duisburg; Manfred Winkelman; Hans G. Winkler, both of Krefeld; Jochen Kopia, Bendorf, all of Fed. Rep. of Germany

[73] Assignee: Didier-Werke AG, Wiesbaden, Fed. Rep. of Germany

[21] Appl. No.: 695,340

[22] Filed: May 6, 1991

[30] Foreign Application Priority Data

May 7, 1990 [DE] Fed. Rep. of Germany ..... 4014509

[51] Int. Cl.[5] ..... C21C 5/48

[52] U.S. Cl. ..... 266/200; 266/265

[58] Field of Search ..... 266/217-224, 266/186, 233, 265, 266

[56] References Cited

U.S. PATENT DOCUMENTS

| | | | |
|---|---|---|---|
| 3,490,755 | 1/1970 | Lutgen | 266/220 |
| 4,944,496 | 7/1990 | Thrower et al. | 266/220 |
| 5,050,847 | 9/1991 | King | 266/220 |

FOREIGN PATENT DOCUMENTS

| | | | |
|---|---|---|---|
| 0221250 | 5/1987 | European Pat. Off. . | |
| 325709 | 8/1989 | European Pat. Off. | 266/265 |
| 46312 | 3/1985 | Japan | 266/219 |

*Primary Examiner*—Melvyn J. Andrews

*Attorney, Agent, or Firm*—Wenderoth, Lind & Ponack

[57] ABSTRACT

A gas flushing apparatus for use with a metallurgical vessel is disclosed which is operable to allow for adjustment of the flow rate of gas through the gas flushing apparatus into molten metal contained in the metallurgical vessel. Such adjustability is provided according to the invention by providing at least a pair of discrete gas-permeable portions extending through the gas flushing apparatus from a bottom end thereof to a top end thereof. The discrete gas-permeable portions are individually connected to a gas supply by a gas distribution mechanism. The gas distribution mechanism is operable to distribute gas from a supply line to either or both of the at least two discrete gas-permeable portions of the gas flushing apparatus. The gas-permeable portions can be formed with cross sections which differ in shape from the lower portions of the gas-permeable portions to the upper portions thereof. Also, the two discrete gas-permeable portions can be provided with differing cross sectional areas.

25 Claims, 2 Drawing Sheets

GAS FLUSHING APPARATUS FOR METALLURGICAL VESSEL

BACKGROUND OF THE INVENTION

1. Field of the Invention

The present invention relates generally to a gas flushing apparatus for a metallurgical vessel, and more particularly to a gas flushing apparatus having a gas permeable portion which is adapted for connection to a gas supply and which extends from a bottom end to a top end of the gas flushing apparatus.

2. Description of the Prior Art

Gas flushing apparatus, such as capillary gas flushing apparatus and labyrinth gas flushing apparatus, have been known in the art. Such gas flushing apparatus generally include a gas-permeable portion which is adapted for connection to a single gas line. The gas-permeable portion must have a cross sectional dimension engineered to allow a volume of gas which is to pass therethrough to be forced into the metallurgical vessel (i.e. into the molten metal contained in the metallurgical vessel) at a speed which is adequate for proper flushing. It is necessary to vary the rate (i.e. volume per unit time) at which gas is injected into the molten metal to provide for various types of flushing. For example, when a "fine flushing" is desired, the gas flow rate must be reduced. With such conventional gas flushing apparatus, the reduction in gas flow rate results in a reduction of the speed at which the gas is injected into the molten metal. Such reduction in the speed of gas injection into the molten metal deleteriously effects the mixing of the flushing gas with the molten metal.

A gas flushing apparatus has been disclosed in EP 0 221 250 Al which is designed to provide an increased gas flow velocity so as to compensate for a reduction in gas flow velocity due to frictional resistance and the like as the gas flows through the gas flushing apparatus. This increase in gas flow velocity is accomplished by shaping the gas passage of the gas flushing apparatus in the shape of a nozzle. However, this design does not overcome the above-noted disadvantage of a reduction in the speed of gas flow upon reducing the rate of gas flow through the gas flushing apparatus.

SUMMARY OF THE INVENTION

Accordingly, an object of the present invention is to provide a gas flushing apparatus which will allow the gas flow rate therethrough to be adjusted without resulting in a corresponding adjustment in the speed of gas flow into the molten metal contained in the metallurgical vessel.

In view of this object, a gas flushing apparatus for use with a metallurgical vessel is disclosed which comprises a body having a top end, a bottom end, and a pair of discrete gas-permeable portions extending through the body from the top end to the bottom end. In order to provide a high gas flow rate through the gas flushing apparatus and into the molten metal contained in the metallurgical vessel, gas is injected through both of the discrete gas-permeable portions of the gas flushing apparatus. If, however, only a low gas flow rate is desired into the molten metal contained in the metallurgical vessel, a relatively smaller volume of gas (i.e. a lower gas flow rate) is directed through only one of the pair of discrete gas-permeable portions of the gas flushing apparatus. In this manner, since the cross sectional area of only one of the pair of gas-permeable portions is smaller than the combined cross sectional area of both of the discrete gas-permeable portions of the gas flushing apparatus, when a lower volume of gas is directed through the single gas-permeable portion, the speed of gas flow into the molten metal contained in the metallurgical vessel is relatively equal to the speed at which the gas is injected into the molten metal through both of the discrete gas-permeable portions when a larger volume of gas is directed through the gas flushing apparatus.

When the gas flushing apparatus of the present invention is provided with two such discrete gas-permeable portions and such gas-permeable portions have identical cross sections, the gas flow rate through the gas flushing apparatus can be adjusted between two levels, while maintaining the speed of gas flow into the molten metal at a predetermined level. When, however, the gas flow apparatus is provided with two discrete gas-permeable portions having different cross sectional areas, the flow rate of gas through the flushing apparatus can be adjusted to three different levels, while maintaining the speed of gas flow into the molten metal contained in the metallurgical vessel at a predetermined level. Likewise, when the gas flushing apparatus is provided with three discrete gas-permeable portions which have identical cross sectional areas, the gas flow rate through the gas flushing apparatus can be adjusted between three different levels while maintaining the speed of gas flow into the molten metal contained in the metallurgical vessel at a predetermined level.

This concept can be extended to providing the gas flushing apparatus with more than three gas-permeable portions with identical or different cross sectional areas, so as to provide for additional gas flow rate adjustment levels while maintaining a predetermined speed of gas flow into the molten metal contained in the metallurgical vessel. Each of the gas-permeable portions of the gas flushing apparatus is contemplated as being convergent or tapered inwardly from the bottom end of the gas flushing apparatus to the top end thereof.

The discrete gas-permeable portions of the gas flushing apparatus of the present invention can be designed with an upper portion thereof having a first cross sectional shape and a lower portion thereof having a second cross sectional shape different than the first cross sectional shape. Such provision of such different cross sectional shapes in the upper and lower portions of the gas-permeable portions allows wear of the gas flushing apparatus to be detected.

BRIEF DESCRIPTION OF THE DRAWINGS

Other objects and advantages of the present invention will become apparent to those skilled in the art from a reading of the following detailed description of the invention taken in conjunction with the drawing figures in which.

DETAILED DESCRIPTION OF THE INVENTION

Figure 3:
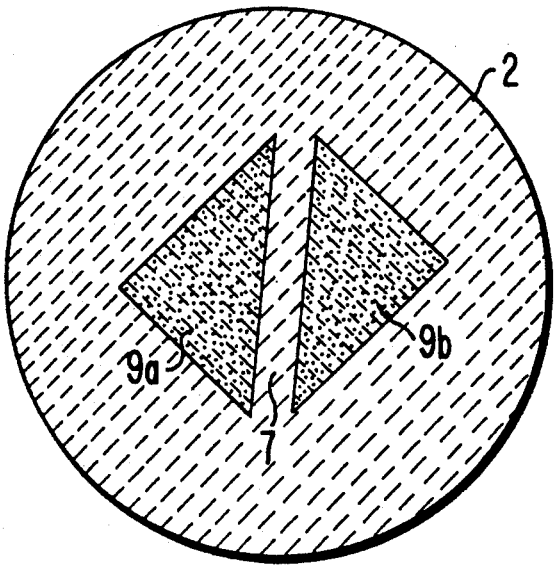
FIG. 3 shows a cross sectional view taken along line III—III of FIG. 1.

A gas flushing apparatus according to a first embodiment of the present invention will now be described with reference to FIGS. 1 through 3.

Figure 1:
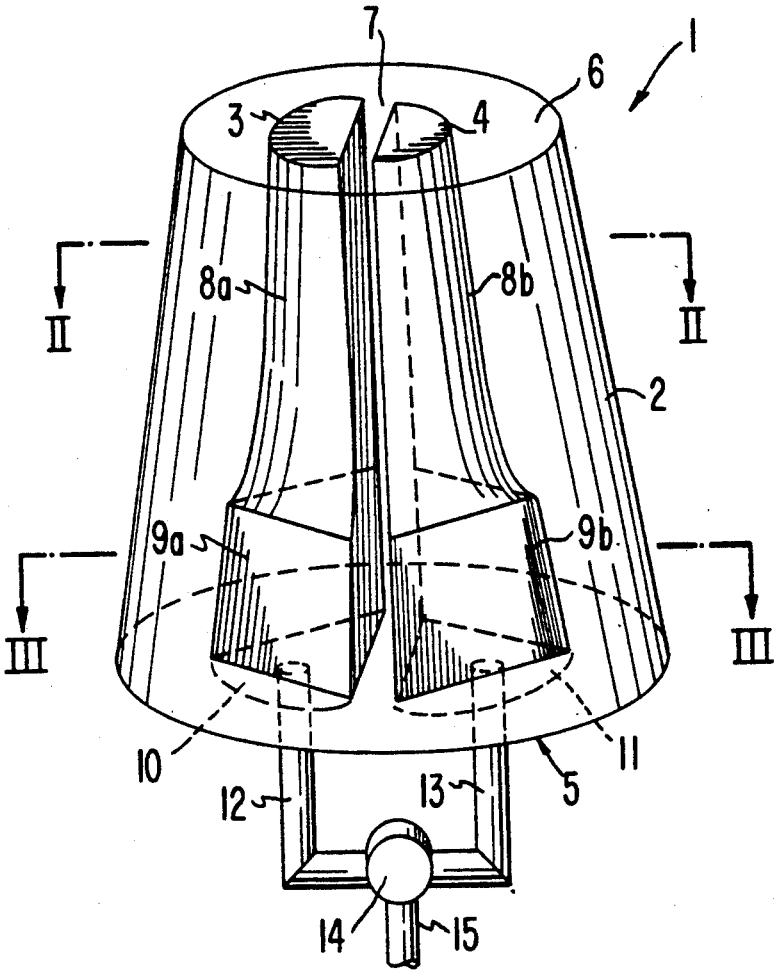
FIG. 1 shows a perspective view of a gas flushing apparatus according to a first embodiment of the present invention.
Figure 2:
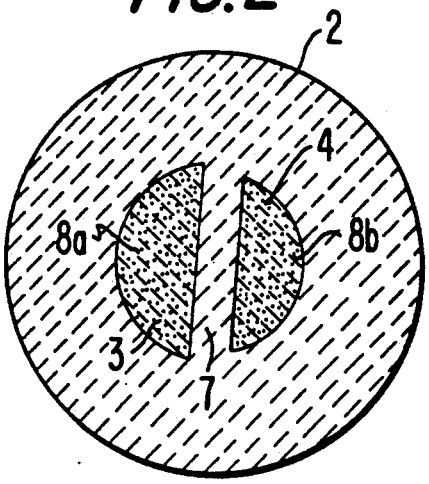
FIG. 2 shows a cross sectional view taken along line II—II of FIG. 1.

As shown in FIG. 1, the gas flushing apparatus of the present invention is formed as a frusto-conically shaped gas flushing cone 1 having a body 2 and a pair of discrete gas-permeable portions 3, 4 extending through the body 2 from a bottom end 5 thereof to a top end 6 thereof. The body 2 of the gas flushing cone 1 is preferably formed of a ceramic material which is not permeable to gas, and the gas-permeable portions 3, 4 of the gas flushing cone 1 are preferable formed of a porous ceramic material. Alternatively, the gas-permeable portions 3, 4 of the gas flushing cone 1 can be formed as a plurality of capillaries.

The gas-permeable portions 3, 4 of the gas flushing cone 1 are separated along their entire length by a center dividing portion 7 of the body 2. In this first preferred embodiment of the invention, a first 3 of the pair of gas-permeable portions 3, 4 includes an upper portion 8*a* having a semi-circular cross section, and a lower portion 9*a* having a triangular cross section. Likewise, a second 4 of the gas-permeable portions 3, 4 includes an upper portion 8*b* having a semi-circular cross section, and a lower portion 9*b* having a triangular cross section. The first and second gas-permeable portions 3, 4 of the gas flushing cone 1 are convergent or tapered inwardly from the bottom end 5 to the top end 6 of the gas flushing cone 1. Such tapering of the gas-permeable portions 3, 4 provides a nozzle effect for the gas flow through the gas flushing apparatus which causes increased flow speed of the gas to compensate for losses occurring during flow of the gas through the gas-permeable portions 3, 4. Additionally, the upper portion 8*a* of the first gas-permeable portion 3 has a larger cross section than the upper portion 8*b* of the second gas-permeable portion 4, such that the gas flow speed through only the second gas-permeable portion 4 can be equal to that which would flow through only the first gas-permeable portion 3 even when a lower volume of gas (or lower gas flow rate) is injected through the second gas-permeable portion 4 than is injected through the first gas-permeable portion 3.

A gas connection means is provided at the bottom end 5 of the gas flushing cone 1 and includes a pair of gas distribution chambers 10, 11 mounted adjacent the bottom ends of the gas-permeable portions 3 and 4, respectively. A pair of gas connection lines 12, 13 lead individually into the gas distribution chambers 10, 11, respectively, and a gas supply line 15 is adapted for connection to a gas supply and is connected to the gas connection lines 12, 13. A three-way valve 14 is connected between the gas supply line 15 and the two connection lines 12, 13 for distributing gas flowing through the gas supply line 15 to the two gas connection lines 12, 13. The three-way valve is designed so as to allow the flushing gas flowing through the gas supply line 15 to be distributed selectively to either the first gas-permeable portion 3, the second gas-permeable portion 4 or both gas-permeable portions 3, 4.

Operation of the gas flushing apparatus according to the first embodiment of the invention will now be described. Due to the provision of the three-way valve 14 and of the two discrete gas-permeable portions 3, 4 having upper portions with different cross sectional areas, the flow rate (or volume per unit time) of gas through the gas flushing apparatus and into molten metal contained in a metallurgical vessel (not shown) can be adjusted between three levels while the speed of gas flow through the gas flushing apparatus is maintained at a constant level for each of the three gas flow rates.

That is, a "high-intensity flushing" can be accomplished by setting the three-way valve to distribute gas to both of the gas connection lines 12, 13 and into the two gas-permeable portions 3, 4, respectively. A "normal flushing" can be provided by selecting a position of the three-way valve 14 in which gas from the gas supply line 15 is distributed only through gas connection line 12 and into the first gas-permeable portion 3. Finally, a "fine flushing" can be provided by selecting the position of the three-way valve 14 in which gas from the gas supply line 15 is distributed only through the gas connection line 13 and into the second gas-permeable portion 4. The volume of gas flowing through the gas supply line 15 can be adjusted by any suitable means such as a known control valve or a known variable bypass valve. The volume of gas distributed by the three-way valve 14 should be proportional to the total cross sectional area of the upper portion or portions of the gas-permeable portion or portions 3, 4 through which gas is to be injected in any particular circumstance.

The provision of differently shaped cross sections for the upper and lower portions of the gas-permeable portions 3, 4 provides a means for detecting the wear of the gas flushing cone 1. That is, when gas is injected into the lower portions 9*a*, 9*b* of the gas-permeable portions 3, 4, respectively, the gas fills the entire triangular cross section thereof, but when the gas flows into the upper portions 8*a*, 8*b*, it is forced to adapt to the semi-circular cross sections of the upper portions by the walls thereof. Accordingly, upon flowing from the triangular cross sectional portions 9*a*, 9*b* to the semi-circular cross sectional portions 8*a*, 8*b*, the gas will bear against the transitional portion of the upper portions 8*a*, 8*b* and eventually wear away the walls thereof into shapes more similar to the cross sectional shapes of the lower portions 9*a*, 9*b*. Therefore, the degree of wear of the gas flushing cone 1 can be determined by viewing the degree to which the upper portions 8*a*, 8*b* of the gas-permeable portions 3, 4 have adapted to triangular cross sections.

Figure 4:
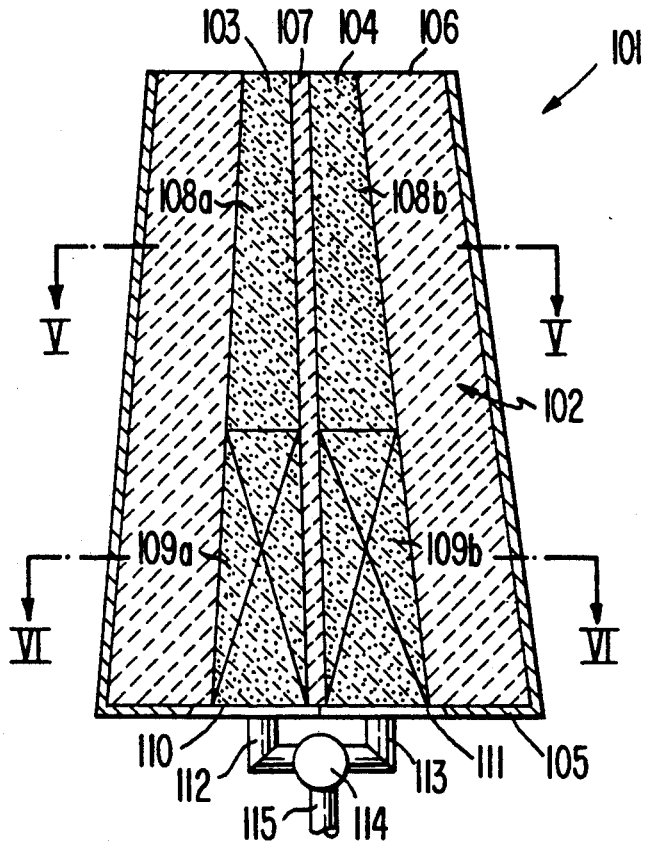
FIG. 4 shows a longitudinal cross sectional view of a gas flushing apparatus according to a second embodiment of the present invention.
Figure 5:
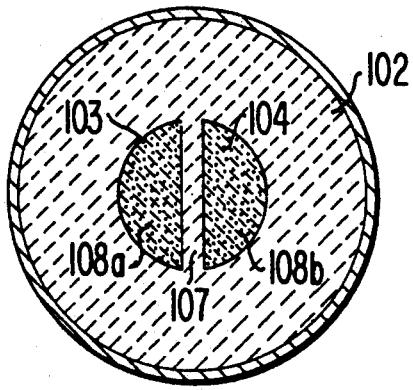
FIG. 5 shows a cross sectional view taken along line V—V of FIG. 4.
Figure 6:
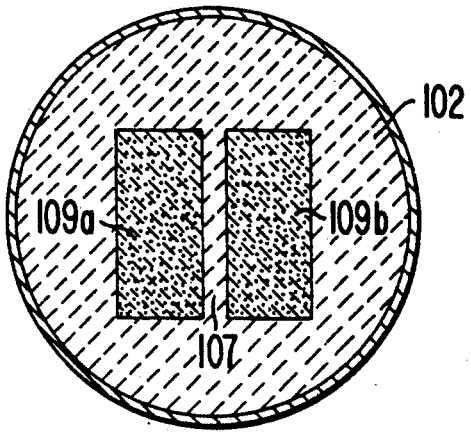
FIG. 6 shows a cross sectional view taken along line VI—VI of FIG. 4.

A second embodiment of the present invention will now be described with reference to FIGS. 4 through 6.

As in the first embodiment, the gas flushing apparatus of this second embodiment includes a frusto-conically shaped gas flushing cone 101 which is formed of a body 102 and a pair of discrete gas-permeable portions 103, 104. The body 102 includes a center dividing portion 107 which separates the two gas-permeable portions 103, 104 along their entire length. As in the first embodiment, the first gas-permeable portion 103 includes a lower portion 109*a* and an upper portion 108*a*, and the second gas-permeable portion 104 includes a lower portion 109*b* and an upper portion 108*b*. However, in this embodiment, the lower portions 109*a* and 109*b* have rectangularly shaped cross sections as shown in FIG. 6. Additionally, the upper portions 108*a*, 108*b* have semi-circular cross sections which are equal in cross sectional area.

A gas connection means is provided and includes two gas distribution chambers 110, 111 provided adjacent the bottom ends of the gas-permeable portions 103, 104, respectively, a pair of individual gas connection lines 112, 113 connected into the gas distribution chambers 110, 111, respectively, a gas supply line 115 for feeding gas from a gas supply (now shown) to the two gas connection lines 112, 113, and a valve 114 for connecting the gas supply line 115 to the gas connection lines 112, 113.

In this embodiment, the valve 114 is designed to allow gas to be selectively distributed from the gas supply line 115 to both of the gas-permeable portions 103, 104 or to only one of the two gas-permeable portions 103, 104.

With this arrangement, the gas flow rate through the gas flushing apparatus into the molten metal contained in the metallurgical vessel can be adjusted between two levels, while maintaining the gas flow speed equal for the two levels. That is, if the valve 114 is switched to a position in which gas is distributed from the gas supply line 115 to both of the gas connection lines 112 and 113, a relatively high volume of gas can be injected through the gas flushing apparatus. When the valve 114 is positioned so as to distribute gas from the supply line 115 into only one of the two gas connection lines 112 and 113, gas is injected through only one of the gas-permeable portions 103, 104. In this manner, a volume of gas can be injected through the gas flushing apparatus which is half of the volume injected therethrough when the valve 114 is positioned to distribute gas through both of the gas-permeable portions 103, 104.

Again, as in the first embodiment, the provision of gas-permeable portions 103, 104, which have upper portions of a semi-circular cross section and lower portions of a rectangular cross section, allows for detection of the degree of wear of the gas flushing cone 101.

Although the first and second embodiments of the present invention have been described as including only two discrete gas-permeable portions, it is contemplated that more than two gas-permeable portions can be provided either with like or different cross sectional areas, with a corresponding increase in the number of gas distribution chambers and gas connection lines as well as a corresponding increase in the number of passages through the valve which distributes gas from the supply line to the gas connection lines. Furthermore, although the first embodiment has been described as including gas-permeable portions having upper portions of a semi-circular cross section and lower portions of triangular cross section and the second embodiment has been described as having gas-permeable portions with upper portions of semi-circular cross section and lower portions of rectangular cross section, it is contemplated that the gas-permeable portions can be provided with many differently shaped and sized cross sections. Furthermore, although the gas connection means of the present invention has been described as including a multi-way valve for distributing gas from a supply line to gas connection lines, any suitable means of distributing gas from a gas supply line or from plural gas supply lines to the gas connection lines can be used.

Although preferred embodiments of the present invention have been set forth in the above description, many modifications will be apparent to those of ordinary skill in the art, and should be construed as being within the scope of the invention, as defined in the appended claims.

What is claimed is:

1. A flushing apparatus for use with a metallurgical vessel, comprising a body having a top end, a bottom end, and a pair of discrete gas-permeable portions extending through said body from said top end to said bottom end; and wherein one of said pair of discrete gas-permeable portions has a cross section which is different than a cross section of the other of said pair of discrete gas-permeable portions.

2. A flushing apparatus as recited in claim 1, wherein said body includes a center dividing portion separating said pair of discrete gas-permeable portions.

3. A flushing apparatus as recited in claim 1, wherein one of said pair of discrete gas-permeable portions is larger in cross section than the other of said pair of discrete gas-permeable portions.

4. A flushing apparatus as recited in claim 1, wherein said gas-permeable portions are formed of porous ceramic material.

5. A flushing apparatus as recited in claim 1, wherein said body is formed of ceramic material which is substantially impermeable to gas.

6. A flushing apparatus for use with a metallurgical vessel, comprising a body having a top end, a bottom end, and a pair of discrete gas-permeable portions extending through said body from said top end to said bottom end; and wherein cross sectional areas of said discrete gas-permeable portions increase from top ends thereof to bottom ends thereof, respectively.

7. A flushing apparatus as recited in claim 6, wherein said upper sections are semi-circular in cross section, and said lower sections are rectangular in cross section.

8. A flushing apparatus as recited in claim 7, wherein said body is frustoconically shaped.

9. A flushing apparatus for use with a metallurgical vessel, comprising a body having a top end, a bottom end, and a pair of discrete gas-permeable portions extending through said body from said top end to said bottom end; and wherein said gas permeable portions have upper sections and lower sections, said upper sections having different cross sectional shapes than said lower sections, respectively.

10. A flushing apparatus as recited in claim 9, wherein said upper sections are semi-circular in cross section, and said lower sections are triangular in cross section.

11. A flushing apparatus as recited in claim 10, wherein said body is frustoconically shaped.

12. A flushing apparatus for use with a metallurgical vessel, comprising:

a body having a top end, a bottom end, and a pair of discrete gas-permeable portions extending through said body from said top end to said bottom end;

means for connecting said gas-permeable portions to a supply of gas; and wherein said connecting means comprises a multi-way valve adapted to be connected to the supply of gas, and a pair of gas connection lines respectively connecting said pair of discrete gas-permeable portions to said multi-way valve.

13. A flushing apparatus as recited in claim 12, wherein said connecting means comprises a first gas distribution chamber adjacent a bottom end of one of said gas-permeable portions and a second gas distribution chamber adjacent a bottom end of the other of said gas-permeable portions.

14. A flushing apparatus as recited in claim 12, wherein said body includes a center dividing portion separating said pair of discrete gas-permeable portions.

15. A flushing apparatus as recited in claim 12, wherein said pair of discrete gas-permeable portions have substantially identical cross sections.

16. A flushing apparatus as recited in claim 12, wherein said gas-permeable portions are formed of porous ceramic material.

17. A flushing apparatus as recited in claim 12, wherein said body is formed of ceramic material which is substantially impermeable to gas.

18. A flushing apparatus for use with a metallurgical vessel, comprising:

a body having a top end, a bottom end, and a pair of discrete gas-permeable portions extending through said body from said top end to said bottom end;

means for connecting said gas-permeable portions to a supply of gas; and wherein one of said pair of discrete gas-permeable portions has a cross section which is different than a cross section of the other of said pair of discrete gas-permeable portions.

19. A flushing apparatus as recited in claim 18, wherein one of said pair of discrete gas-permeable portions is larger in cross section than the other of said pair of discrete gas-permeable portions.

20. A flushing apparatus for use with a metallurgical vessel, comprising:

a body having a top end, a bottom end, and a pair of discrete gas-permeable portions extending through said body from said top end to said bottom end;

means for connecting said gas-permeable portions to a supply of gas; and wherein cross sectional areas of said discrete gas-permeable portions increase from top ends thereof to bottom ends thereof, respectively.

21. A flushing apparatus as recited in claim 20, wherein said gas permeable portions have upper sections and lower sections, said upper sections having different cross sectional shapes than said lower sections, respectively.

22. A flushing apparatus as recited in claim 21, wherein said upper sections are semi-circular in cross section, and said lower sections are triangular in cross section.

23. A flushing apparatus as recited in claim 22, wherein said body is frustoconically shaped.

24. A flushing apparatus as recited in claim 20, wherein said upper sections are semi-circular in cross section, and said lower sections are rectangular in cross section.

25. A flushing apparatus as recited in claim 24, wherein said body is frustoconically shaped.

* * * * *